United States Patent [19]

De Longhi

[11] Patent Number: 4,746,785

[45] Date of Patent: May 24, 1988

[54] SELF CONTAINED ELECTRIC OVEN FOR DOMESTIC APPLICATION WITH BAKING ROOM DIRECTLY CONTROLLED BY THERMOSTAT

[75] Inventor: Giuseppe De Longhi, Treviso, Italy

[73] Assignee: De' Longhi S.p.A., Italy

[21] Appl. No.: 888,932

[22] Filed: Jul. 24, 1986

[30] Foreign Application Priority Data

Jul. 24, 1985 [IT] Italy ..... 82539 A/85

[51] Int. Cl.[4] ..... F24C 7/08; H05B 1/02; F27D 11/02

[52] U.S. Cl. ..... 219/386; 219/412; 219/413

[58] Field of Search ..... 219/385, 386, 387, 391, 219/405, 411, 412, 413, 414, 398, 395, 408

[56] References Cited

U.S. PATENT DOCUMENTS

| | | | |
|---|---|---|---|
| 3,585,360 | 6/1971 | Young | 219/405 |
| 4,065,658 | 12/1977 | Keim | 219/413 |
| 4,189,632 | 2/1980 | Swanson | 219/413 |
| 4,382,175 | 5/1983 | Huggler | 219/413 |

FOREIGN PATENT DOCUMENTS

| | | | |
|---|---|---|---|
| 54-122444 | 9/1979 | Japan | 219/386 |
| 57-198928 | 12/1982 | Japan | 219/386 |
| 272767 | 6/1927 | United Kingdom | 219/413 |

*Primary Examiner*—E. A. Goldberg
*Assistant Examiner*—Teresa J. Walberg
*Attorney, Agent, or Firm*—Wigman & Cohen

[57] ABSTRACT

An electrical household appliance having structural members defining a baking room inside which electrical resistances opposed to each other and outside which a thermostat are placed, the thermostat including bimetallic sensors places across a fixed opening and adjustable openings, the baking room being closed by a door. The resistances along with diodes generate variable heat as a function of the operating time of the thermostat controlled by a reducing gearing device.

9 Claims, 1 Drawing Sheet

SELF CONTAINED ELECTRIC OVEN FOR DOMESTIC APPLICATION WITH BAKING ROOM DIRECTLY CONTROLLED BY THERMOSTAT

FIELD OF THE INVENTION

The present invention relates to a self-contained electrical oven for domestic application with a baking room directly controlled by a thermostat and with devices and structural members for the heat treatment controlled by thermoregulating devices acting directly in the baking room.

BACKGROUND OF THE INVENTION

As it is known the self-contained electrical ovens allow the food to be heat treated and baked. At the present status of art some ovens are equipped with multiple electrical resistances placed in the section of the oven underlying the baking room. Some other ovens are also provided with resistances placed in the section of the oven overlying the baking room. Both resistances assemblies are connected to thermostatic means embodied in the electrical resistances.

Such a construction causes a lot of troubles especially due to the indirect thermic control of the baking room which is carried out on the body of the above mentioned resistances.

The heat generated by and stored in the resistance assemblies of the upper section, as well as transmitted by infrared radiations to the baking room, causes frequent power supply cutoff effected by the thermostatic device even before an effective treatment of the food. The differential operating times of the bimetallic thermostats due to the hysteresis of the plates and the non-dispersed heat latent therein, in the above mentioned arrangement of the resistance assemblies, are generally very frequent and above all not suitable to the thermic conditions and the actual transmitted heat in particular to the center of the baking room.

Such an operation under these conditions causes among other harmful effects outward cold flows of the mass humidity with the consequences of a less effective thermic treatment.

In order either to prevent or to restrict the reiterated power supply cutoff in the common application it is customary to open the door of the oven so as to reduce the frequency of the thermostat operations.

In case of resistances equipped with thermostats embodied in or directly connected to the resistance shanks it is self evident that the drawback caused by carrying out the control of the heat generated by the resistance instead of controlling the heat in the baking room generates a lack of thermic balance.

In case of controlling both functions the above mentioned troubles make it necessary the application of limiting devices for one of the functions.

It is also self evident that the used thermostats, the mechanical and electrical connections of the several regulation and control members and safety devices necessary to achieve satisfying results are causing relevant manufacturing costs due also to the modular and multiple resistances used to achieve different heat developments.

The direct control of the actual heat in the baking room has not been carried out in any of the above mentioned embodiment.

SUMMARY OF THE INVENTION

The present invention aims to eliminate such drawbacks and the consequences thereof.

The invention as characterized in the claims solves these problems by providing a self-contained electrical oven for domestic application with baking room directly controlled by thermoregulating sensor means. The thermoregulating sensor means is connected so as to be influenced and operated only by the heat in the center of the baking room which is generated by electrical resistances wherever placed and however operated.

The advantages achieved by the present invention essentially consist in that the heat transmission is continuous and progressive without interruption due to overheating so that the differential operating times have no influence on the treated product.

Another advantage is provided by the simultaneous operation of the electrical resistances so as to achieve a quick heating of the baking room.

The flows of the mass humidity of the treated product are influenced only by internal and induced convection which is balanced in accordance with the heat evenly and progressively absorbed by the volume subjected to the thermic development.

Among the basic purpose there is the provision of an oven having a full reliability and safety of use such that checks or interventions of the user are not necessary during the normal operation of the apparatus.

Among the advantages there is also that of the use of only two resistances opposed to each other across the baking room and having the whole active surface delivering the requested electric power and cooperating with diodes connected in associated circuits.

The simple construction makes the industrial manufacturing less expensive with respect to equivalent apparatus, in particular owing to a relevant reduction of basic components and accessories.

BRIEF DESCRIPTION OF THE DRAWINGS

The present invention will be described herebelow in detail with reference to the accompanying drawing illustrating one of the preferred embodiment.

DETAILED DESCRIPTION OF THE DRAWING

Figure 1:
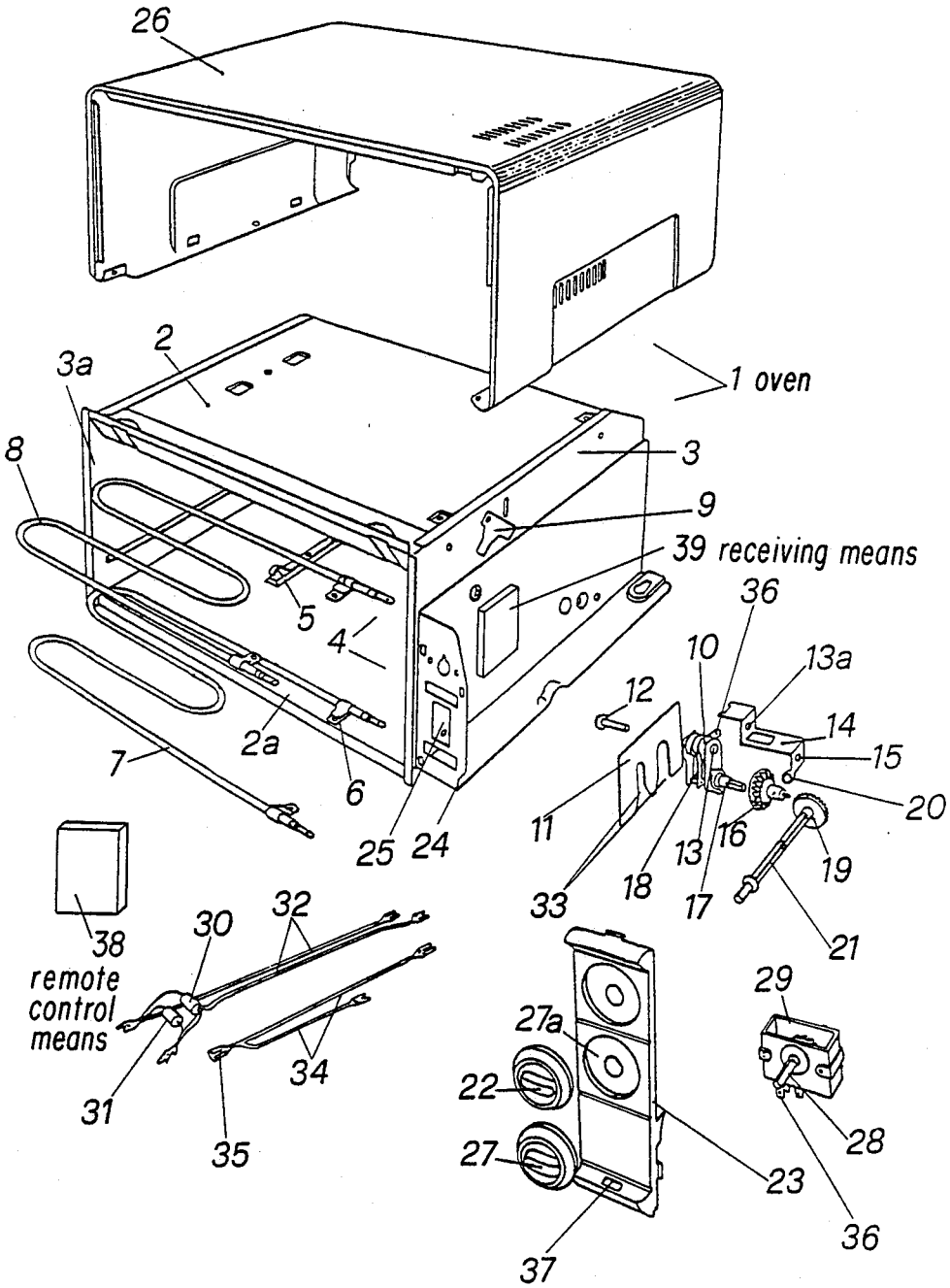
FIG. 1 shows a perspective exploded view of the oven for domestic application of the present invention without front door for the sake of simplicity.

According to the invention the drawing shows a self-contained electrical oven for domestic applications with a baking room directly controlled by thermoregulating means and with devices and structural members 2, *2a*, 3, *3a*. The oven 1 consists of a baking room 4 provided with seats 5 of connectors 6 for the fastening of the upper and lower electrical resistances 7 and 8, respectively.

In accordance with the invention the side wall 3 is provided with a housing 9 suitable for the fastening of the thermostat 10 with the interposition of the insulating shaped plate 11 by the insertion of the screws 12 into the seat 13 of the thermostat and into the seat 13*a* of the bracket 14 provided with an opening 15 supporting the gear 16 journalled on the axle 17 controlling the above mentioned thermostat 10. The thermostat 10 is provided with bimetallic plates 18 and is operated by the gear 19 rotating in the bush 20 and connected by the axle 21 to the controlling knob 22 which is placed on the control panel 23 fastened to the bracket 24 provided with corresponding openings 25. The whole apparatus is protected by the cover 26.

The selection of one or more resistances 7, 8 and the regulation of the thermic capacity thereof is affected by the knob 27 housed in the seat 27*a* of the control panel 23 and connected to the axle 28 of the switch 29 for the insertion of suitable diodes 30 and 31 connected in the circuits 32.

According to the showed preferred embodiment the system for the thermic stabilization of the baking room 4 of the oven makes use of the above mentioned thermostat 10 directly connected to the room across the housing 9 and protected by the insulating section 11 which is provided with at least an opening 33 for the positioning and the protection of the heat sensor 18.

The conductors 34 are provided with clamps 35 for the connection to corresponding connectors 36 of the thermostat 10, the switch 29 and interfacing devices. The opening 37 is the seat for the housing of warning lights and/or acoustic signallers.

If requested or according to the operating conditions of the thermostat 10, its components and in particular the sensor 18, the positions and the form of the housing 9 on the side wall 3 and of the opening 33 can be varied. The invention reaches its purpose by means of a thermoregulating device directly associated to the baking room and controlling the heat developped by the electrical resistances.

The electrical resistances are associated to suitable transistors or diodes and generate the heat under control of a switch servo-controlled by the thermostat operating according to the requiested heat treatment. In case of automatic or programmable operation time switches interacting with the above mentioned devices are used.

Interactions and regulations may also carried out by suitable remote controls 38 operating together with receiving means 39 placed in the oven.

In order to attain over-gearing or gearing down effects the gears 16 and 19 or the like can consist of gearing-up devices or reduction gears to vary the speed of rotation of the axle 17 of the thermostat 10.

The present invention as illustrated and described can be subjected to many modifications and changes without departing from its scope as well as all the components can be replaced by equivalent ones, as defined by the appended claims.

What is claimed is:

1. Self-contained electrical oven for domestic application with a baking room directly controlled by a thermoregulating means, comprising a baking room (4) having structural members including opposed bases (2, 2*a*), opposed side walls (3, 3*a*), a bracket (24), and a cover (26), as well as a thermostat (10) assembled in the baking room by means of a shaped bracket (14) and provided with sensors (18) oriented towards a housing (9) in the wall (3) of the baking room (4) formed also of the bases (2, 2*a*) with connectors (5, 6) for electrical resistances (7, 8) and of the bracket (24) for fastening of control and supplying devices (16, 17, 19, 21 to 23, 27, 29 to 37), the sensors (18) of the thermostat (10) being protected by a shaped plate (11) provided with openings (33) said plate being arranged in the side wall (3) facing the baking room (4) of the oven (1), characterized in that the sensors (18) of the thermostat (10) directly sense the heat in the baking room (4) heated by the electrical resistances (7, 8) through an opening fixed in housing (9) and the openings (33) of the shaped plate (11), the electrical resistances being placed in the opposed bases (2, 2*a*) and being servo-controlled by the control and supplying devices (16, 17, 19, 21 to 23, 27, 29 to 37).

2. Self-contained electrical oven according to claim 1, characterized in that the shaped bracket (14) supporting the thermostat (10) is provided with connecting means (20, 36) to an axle (21) of rotation of the gear (19) engaging a gear (16) connected to an axle (17) of rotation of the thermostat (10) rotating in a seat (15).

3. Self-contained electrical oven according to claim 1, characterized in that the shaped plate (11), which is placed between the wall (3) and the thermostat (10) and fastened by a screw (12) passing through an opening (13) in the thermostat (10) and engaging an opening (13*a*) in a brackt (14), is provided with at least one opening (33) facing the sensor (18) of the thermostat (10).

4. Self-contained electrical oven according to claim 1, characterized in that the electrical resistances (7, 8) are connected to diodes (30, 31) which reduce the heat generating capacity and are operated under control of switches (29) controlled in turn by members (22, 27) placed on a control panel (23).

5. Self-contained electrical oven according to claim 1, characterized in that the electrical resistances (7, 8) are either operated under separate control or simultaneously by a switch (29) and are servo-controlled by the thermostat (10).

6. Self-contained electrical oven according to claim 1, characterized in that gears (16, 19) are provided engaging to each other to drive the thermostat (10) and said gears are either gearing-up means or reduction gears for varying the rotation of an axle (17) of the thermostat (10).

7. Self-contained electrical oven according to claim 1, characterized in that normal or emergency operation is signalled by warning lights and/or acoustic signallers (37).

8. Self-contained electrical oven according to claim 1, characterized in that the oven (1) is servo-controlled by time switches interacting with the thermostat (10).

9. Self-contained electrical oven according to claim 1, characterized in that signal functions are controlled by remote control means (38) associated to receiving means (39) placed in the oven (1).

* * * * *